US005544749A

United States Patent [19]

Watts

[11] Patent Number: 5,544,749

[45] Date of Patent: Aug. 13, 1996

[54] CARRIER WITH REFLECTIVE MEANS TO BLOCK READING OF A BAR CODE

[75] Inventor: Leslie M. Watts, Medinah, Ill.

[73] Assignee: Illinois Tool Works Inc., Glenview, Ill.

[21] Appl. No.: 382,246

[22] Filed: Feb. 1, 1995

[51] Int. Cl.[6] ..... B65D 85/00; G06K 19/00

[52] U.S. Cl. ..... 206/459.5; 206/150; 235/487; 283/91; 283/901

[58] Field of Search ..... 206/427, 459.5, 206/150; 283/77, 83, 901, 85; 235/487, 491, 494

[56] References Cited

U.S. PATENT DOCUMENTS

| | | |
|---|---|---|
| 3,330,408 | 7/1967 | Wanderer . |
| 4,219,117 | 8/1980 | Weaver et al. . |
| 4,359,633 | 11/1982 | Bianco . |
| 4,431,693 | 2/1984 | Skukowski . |
| 4,486,363 | 12/1984 | Pricone et al. . |
| 4,557,375 | 12/1985 | Weaver et al. . |
| 4,669,611 | 6/1987 | Flaherty . |
| 4,827,114 | 5/1989 | Biachon . |
| 4,850,488 | 7/1989 | Humbert . |
| 4,941,573 | 7/1990 | Fuerstman . |
| 5,218,192 | 6/1993 | Fujii et al. . |

*Primary Examiner*—Bryon P. Gehman

*Attorney, Agent, or Firm*—Trexler, Bushnell, Giangiorgi & Blackstone, Ltd.

[57] ABSTRACT

A novel carrier for carrying a group of items, such as cans, bottles or the like which hold beverages, foods or the like, is made of a substantially transparent, plastic material having micro-embossed partial cube-corner type retro-reflector elements on a surface of the carrier. Each item includes an individual machine readable bar code thereon which is at least partially covered by the reflector elements. The package has a machine readable bar code thereon which is not covered by the reflector elements on the carrier. The reflector elements prevent the individual bar codes on the items from being read by a typical bar code reader beam by reflecting the light emitted from the bar code reader so the light cannot penetrate the carrier and read the bar code underneath the reflector elements. The bar code on the package, which when scanned by the bar code reader beam will retrieve package information, can be read by the reader since it is not covered by the reflector elements.

9 Claims, 1 Drawing Sheet

CARRIER WITH REFLECTIVE MEANS TO BLOCK READING OF A BAR CODE

BACKGROUND OF THE INVENTION

This invention is generally directed to a novel, substantially transparent, plastic carrier for a group of items, such as cans, bottles or the like which hold beverages, foods or the like. More particularly, the invention contemplates a plastic carrier which groups together the items and prevents individual bar codes on each item from being read by a typical laser bar code reader beam.

Bar codes are widely used on items so that information about the item, such as price, can be easily and quickly read by scanning the bar code with a bar code reader beam. When the bar code is scanned, the bar code number is input into a computer to retrieve stored information about the item.

When items are grouped together in a package for sale, each item typically includes an individual machine readable bar code. The package is additionally labelled with a bar code which corresponds to the price of the group of items.

In a package that has a substantially transparent carrier, e.g. a band type carrier as shown in U.S. Pat. Nos. 4,219,117 or 4,557,375, when the package is scanned for a price, a bar code from an individual item could be scanned instead of the bar code on the package itself. If this occurs, information which correlates to the individual item would be retrieved and the purchaser of the package will be charged the individual price instead of the group package price. This can result in significant losses to the seller.

The present invention is intended to overcome or minimize these problems as well as to present improvements and additional advantages.

OBJECTS AND SUMMARY OF THE INVENTION

A general object of the present invention is to provide a novel, substantially transparent carrier for a group of items, such as cans, bottles or the like which hold beverages, foods or the like and which will block scanning of bar codes or other indicia on individual items.

Another object of the present invention is to provide a carrier having micro-embossed partial cube-corner type reflector elements thereon which reflect light emitted from a conventional laser bar code reader to prevent individual bar codes on each item from being read by the reader beam.

Briefly, and in accordance with the foregoing, the present invention discloses a novel carrier for carrying a group of items, such as cans, bottles or the like which hold beverages, foods or the like. The items, when encircled by the carrier, form a package. The carrier is made of a substantially transparent, plastic material and has a plurality of micro-embossed partial cube-corner type retro-reflector elements thereon. Each individual item includes an individual machine readable bar code thereon which, when the carrier is attached thereto, is at least partially covered by the reflector elements. The micro-embossed reflector elements prevent the individual bar code on the individual items from being read by a typical laser bar code reader by reflecting the light emitted by the reader when the reflective surfaces are adjacent to the container. The package may have a machine readable bar code affixed thereon which is not covered by the reflector elements. The package bar code can be read by the laser bar code reader to retrieve data about the package, such as the price of the complete package.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENT

Figure 1:
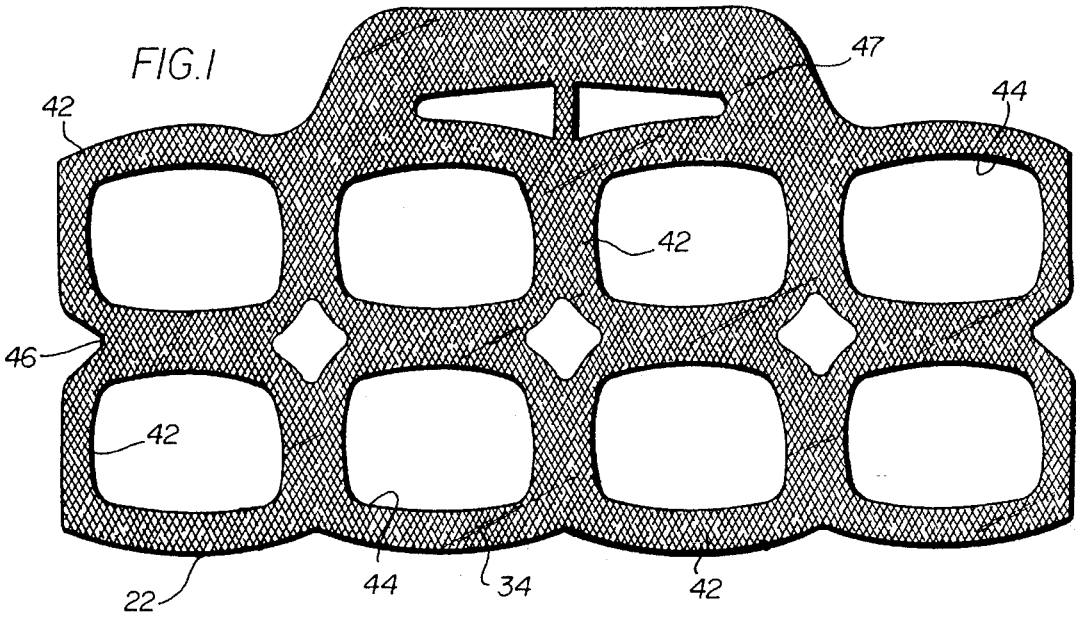
FIG. 1 is a plan view of a carrier having micro-embossed partial cube-corner type reflector elements thereon which incorporates features in accordance with the present invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 2:
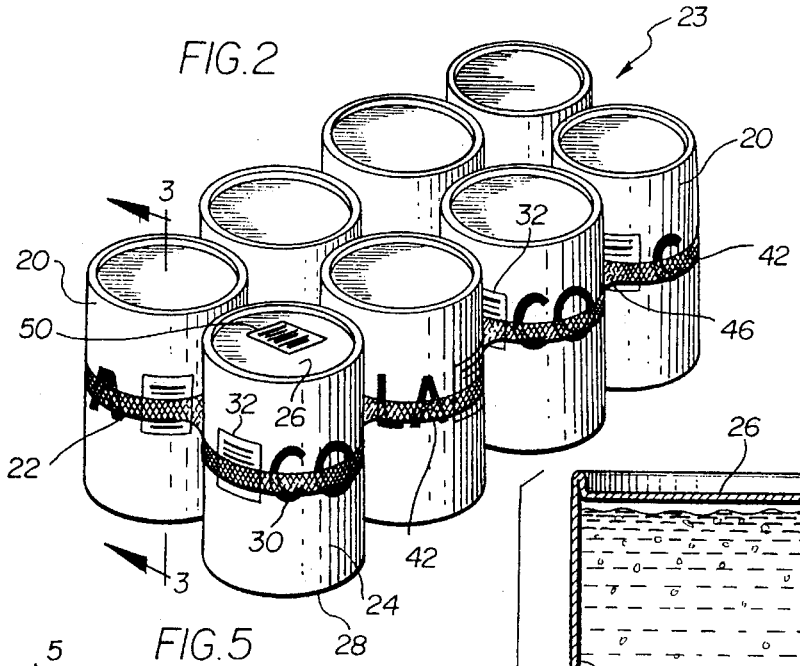
FIG. 2 is a perspective view of a plurality of cans encircled by the carrier shown in FIG. 1.
Figure 4:
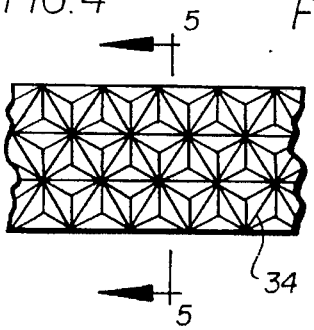
FIG. 4 is an enlarged, fragmentary, plan view of of the embossed surface of the carrier.
Figure 5:
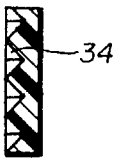
FIG. 5 is an enlarged cross section of the embossed surface.

As shown in FIG. 2, a plurality of items, e.g. cans, 20 are grouped together and surrounded by a novel carrier 22, shown in FIG. 1, to form a package 23. The items 20 in the package 23 are typical cans which hold beverages, foods or the like, each of which include a cylindrical side wall 24 having an exterior face, a top wall 26 and a bottom wall 28. The exterior face of the side wall 24 can be decorated with graphics and/or writing 30 for aesthetic purposes or identification of the product.

The exterior face of each item 20 also includes a machine readable bar code 32 thereon having a plurality of horizontal lines. The individual bar codes 32 can be printed on the exterior face of each item 20 or otherwise affixed to the item 20 by suitable means, for example by adhesive. The bar code 32 on each individual item 20 allows the item 20 to be scanned by a typical laser bar code reader (not shown). When the bar code 32 on the item 20 is scanned by a bar code reader, information, such as the price, about the individual item 20 is retrieved from a computer attached to the bar code reader. The bar code scanners or readers used today are Helium/Neon laser bar code readers which typically emit a beam of light in a wavelength of about 630 nanometers to 670 nanometers to scan and read a bar code on an item or package.

The carrier 22 of the present invention is made of a suitable plastic material, such as low to medium density, resilient polyethylene. The carrier 22 is substantially transparent and includes a plurality of micro-embossed partial cube-corner type retro-reflector elements 34 on a surface 36 of the carrier. The reflector elements 34 may be formed by known micro-embossing methods, such as the one disclosed in U.S. Pat. No. 4,486,363.

The structure of cube-corner type reflector elements, such as the reflector elements 34 used in the present invention, are well-known in the art and are often called trihedral or tetrahedron reflector elements. These types of structures consist of three mutually perpendicular faces, without regard to the size or shape of each face. Each face can be of a different size and shape relative to the other two. The micro-embossed partial cube-corner type reflector elements 34 form reflective surfaces that reflect the light emitted from the laser bar code reader. Thus, the light emitted from the laser reader is prevented from penetrating through the substantially transparent carrier 22 to read the portion of the bar code 32 underneath the reflector elements 34. Therefore, when the package 23 is scanned by a bar code reader, the portion of each individual bar code 32 beneath the reflector elements 34 cannot be read and thus, the data which pertains to the individual item 20 cannot be retrieved.

Figure 3:
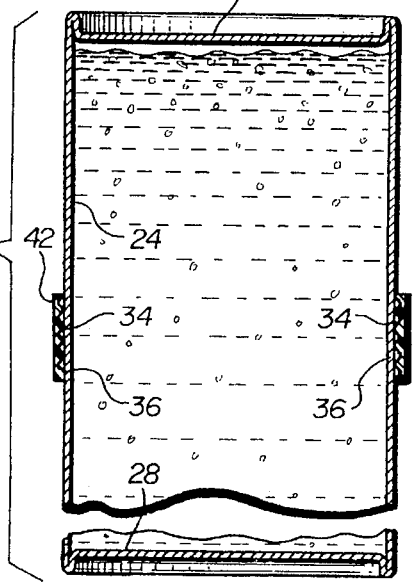
FIG. 3 is cross-sectional view of the cans and the carrier along line 3—3 in FIG. 2.

As shown in FIG. 3, the micro-embossing of the reflector elements 34 is preferably on one surface 36 of the carrier 22. More particularly, the micro-embossing of the reflector elements 34 is preferably on the surface 36 of the carrier 22 that contacts the exterior surface of the side wall 24 of the can 20.

The reflector elements 34 will preferably be embossed over the entire carrier 22 as illustrated. Alternatively, the reflector elements 34 may be micro-embossed along an annular strip.

As shown in FIG. 2, the carrier 22 is made of a plurality of bands 42 having apertures 44 therein. The bands 42 are integrally joined at 46. As shown in FIG. 2, the cans 20 are securely held within the apertures 44 so that each band 42 completely encircles and surrounds each individual can 20. Each band 42 of the carrier 22 resiliently contacts and grips each can 20 along its side wall 24. The carrier 22 may include an integral handle 47.

When the carrier 22 is affixed to the cans 20, to prevent a bar code 32 on an individual can 20 from being read by a bar code reader beam, the carrier 22 is placed in a position along the side wall 24 in such a manner that the micro-embossed reflector elements 34 at least partially cover at least one line on each bar code 32 on each individual can 20. The micro-embossed cube-corner type reflector elements 34 reflect the light emitted by the laser bar code reader beam. Thus, when the laser reader beam scans the package 23, the reflector elements 34 prevent the covered line or lines on the individual bar codes 32 from being read by the bar code reader beam and the information about an individual item 20 cannot be retrieved.

While the reflector elements 34 reflect light, the carrier 22 is substantially transparent and thus, the graphics and/or writing 30 on the cans 20 can be seen through the micro-embossed carrier 22 by the human eye. Therefore, the substantially transparent carrier 22 does not detract from the aesthetics of the graphics and/or writing 30 on the exterior of the can 20. A laser absorbing dye can be added to the carrier also to enhance the blocking function of the reflector elements.

The package 23 may have a machine readable bar code 50 on it which is not covered by the carrier 22. Alternatively, a machine readable bar code may be on the outer surface of the carrier 22 (not shown) so that the bar code is on top of the micro-embossed carrier 22. These bar codes allow a laser bar code reader to retrieve information about the package 23, such as the price of the group of items 20, when these bar codes are scanned by the reader beam. The package bar code 50 may be printed on the exterior of one of the cans 20 or on the carrier 22 or otherwise affixed to a can 20 or the carrier 22 by suitable means, such as adhesive.

The items 20 shown in FIG. 1 are typical cans which hold beverages, foods or the like, however, it is to be understood that other types of items, such as bottles or boxes may be grouped together and surrounded by a like or similar carrier 22. Also, as shown in FIG. 1, the carrier 22 is a continuous band that encircles each can 20. It is to be understood that the carrier 22 may be of a variety of forms, such as a single sheet of plastic formed to fit around the all of the items.

While a preferred embodiment of the present invention is shown and described, it is envisioned that those skilled in the art may devise various modifications of the present invention without departing from the spirit and scope of the appended claims. The invention is not intended to be limited by the foregoing disclosure.

The Invention claimed is:

1. A carrier for carrying a group of discrete containers, each container including an individual machine readable bar code thereon, said carrier comprising a substantially transparent, plastic material having reflector elements thereon, said carrier including portions for extending around the containers to form a package, said reflector elements being disposed on said portions for at least partially covering the individual machine readable bar codes when the carrier is assembled with the containers for preventing machine reading of the bar codes, said reflector elements being micro-embossed reflector elements.

2. A carrier as defined in claim 1, wherein said reflector elements are micro-embossed on only one surface of the carrier, said reflector elements comprising partial cube-corner type reflector elements.

3. A carrier as defined in claim 2, wherein the surface of the carrier that includes the reflector elements contacts an exterior surface of each of the containers when the carrier is assembled with the containers.

4. A carrier as defined in claim 1, wherein said carrier includes a machine readable bar code thereon which is not covered by the reflector elements.

5. A package as defined in claim 1, wherein said plastic material is polyethylene.

6. A package comprising a carrier, a group of items retained by said carrier, each item having an individual machine readable bar code thereon, said carrier comprising plastic material including micro-embossed reflector elements disposed for at least partially overlaying said bar codes for preventing machine reading of said bar codes.

7. A package as defined in claim 6, wherein the carrier is a band-type carrier including individual band segments gripping the individual items.

8. A package as defined in claim 7, wherein said reflector elements are embossed on one surface of the carrier and that one surface contacts the exterior surfaces of said items.

9. A package as defined in claim 8, wherein said plastic material is polyethylene.

* * * * *